US006003603A

United States Patent [19]

Breivik et al.

[11] Patent Number: 6,003,603

[45] **Date of Patent: *Dec. 21, 1999**

[54] METHOD AND SYSTEM FOR OFFSHORE PRODUCTION OF LIQUEFIED NATURAL GAS

[75] Inventors: Kare Breivik, Tau; Arne Olav Fredheim, Trondheim; Pentti Paurola, Hafrsfjord, all of Norway

[73] Assignee: Den Norske Stats Ol jesel skap A.S., Norway

[ * ] Notice: This patent is subject to a terminal disclaimer.

[21] Appl. No.: 08/849,346

[22] PCT Filed: Dec. 8, 1995

[86] PCT No.: PCT/NO95/00227

§ 371 Date: Aug. 11, 1997

§ 102(e) Date: Aug. 11, 1997

[87] PCT Pub. No.: WO96/17777

PCT Pub. Date: Jun. 13, 1996

[30] Foreign Application Priority Data

Dec. 8, 1994 [NO] Norway ..... 944754

[51] Int. Cl.[6] ..... E21B 43/34

[52] U.S. Cl. ..... 166/357; 166/267

[58] Field of Search ..... 166/357, 352, 166/366, 267; 441/3, 4, 5; 114/230.12, 230.13, 230.14

[56] References Cited

U.S. PATENT DOCUMENTS

| | | | |
|---|---|---|---|
| 3,557,396 | 1/1971 | Rupp | 441/5 |
| 3,590,407 | 7/1971 | Bratianu et al. | 114/230.12 X |
| 4,892,495 | 1/1990 | Svensen | 441/5 |
| 5,025,960 | 6/1991 | Mendrin | 166/267 |
| 5,878,814 | 3/1999 | Breivek et al. | 166/357 X |

FOREIGN PATENT DOCUMENTS

| | | |
|---|---|---|
| 2642654 | 3/1978 | Germany . |
| 3200958 | 7/1983 | Germany . |
| 175419 | 7/1994 | Norway . |
| 176129 | 10/1994 | Norway . |

*Primary Examiner*—Frank Tsay
*Attorney, Agent, or Firm*—Banner & Witcoff, Ltd.

[57] ABSTRACT

A method and a system for offshore production of liquefied natural gas, wherein natural gas is supplied from an underground source to a field installation for gas treatment. The gas is transferred in compressed form from the field installation to an LNG tanker. The transfer takes place via a pipeline surrounded by sea water. The compressed gas is supplied to a conversion plant which is provided on the LNG tanker and is arranged to convert at least a part of the gas to liquefied form, and the liquified gas is transferred to storage tanks on board the tanker. When the storage tanks on the LNG tanker are filled up, the pipeline is disconnected from the LNG tanker and connected to another, similar tanker. The pipeline is permanently connected to a submerged buoy which is arranged for introduction and releasable securement in a submerged downwardly open receiving space in the tanker, and which is provided with a swivel unit for transfer of gas under a high pressure.

11 Claims, 3 Drawing Sheets

METHOD AND SYSTEM FOR OFFSHORE PRODUCTION OF LIQUEFIED NATURAL GAS

Figure 1:
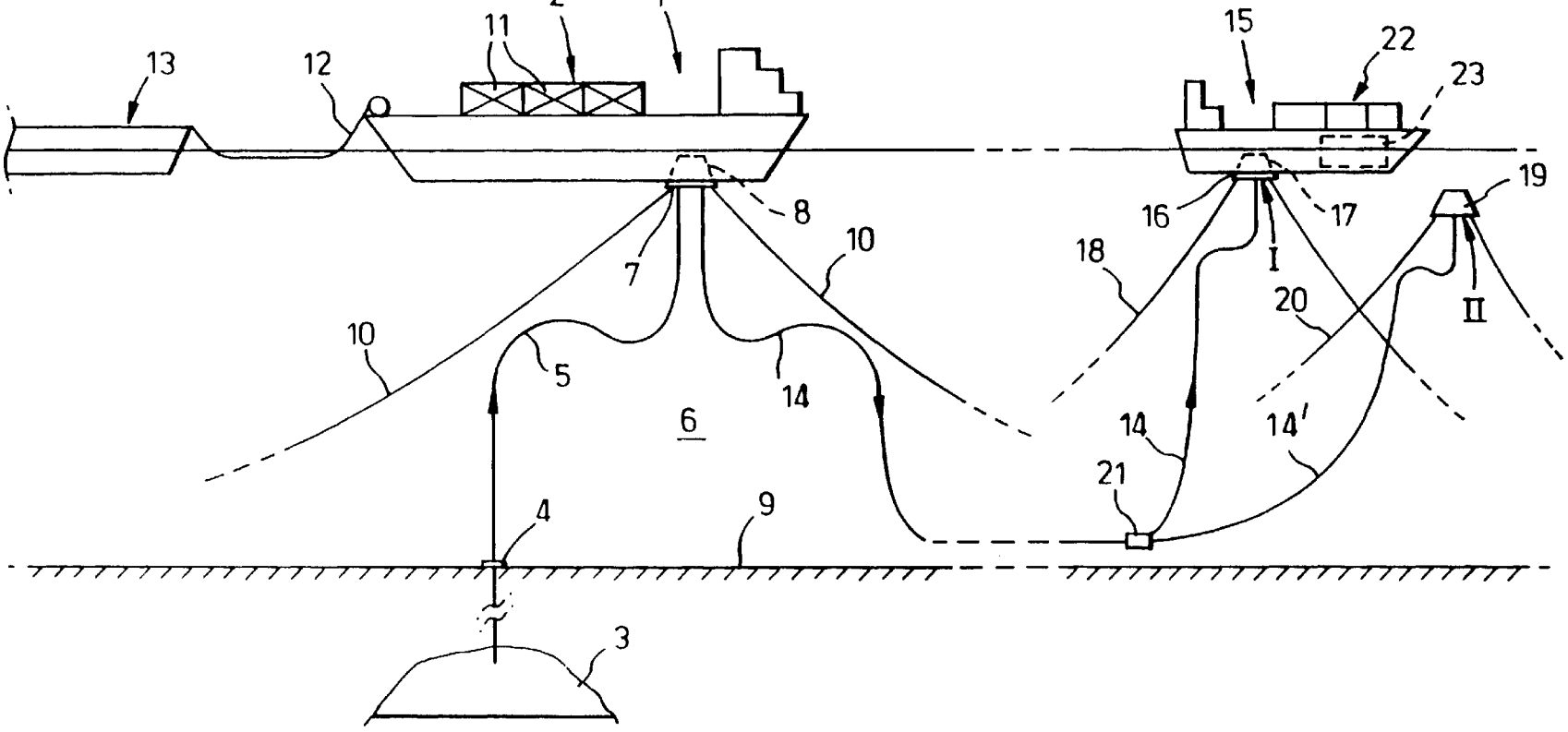

The invention relates to a method for offshore production of liquefied natural gas, wherein natural gas is supplied from an underground source to a field installation for gas treatment, the gas after possible purification being transferred in compressed form from the field installed on to a LNG tanker, the transfer taking place through a pipeline surrounded by sea water, and wherein the compressed gas is fed to a conversion plant provided on the LNG tanker and arranged to convert at least a part of the gas to liquefied form by expansion of the gas, and the so liquefied gas is transferred to storage tanks on board the tanker.

Further, the invention relates to a system for offshore production of liquefied natural gas, comprising a field installation for treatment of natural gas supplied to the installation from an underground source, equipment arranged on the field installation for gas purification and for compression of the natural gas to a high pressure, and a pipeline surrounded by sea water for transfer of the compressed gas to a LNG tanker, the LNG tanker including a plant for conversion of at least a part of the gas to liquefied form by expansion of the gas, and storage tanks for storage of the liquefied gas on the tanker.

A method and a system of the above-mentioned type are known from U.S. Pat. No. 5,025,860. In the known system, the natural gas is purified on a platform or a ship and is thereafter transferred in compressed and cooled form via a high-pressure line to a LNG tanker where the gas is converted to liquefied form by expansion. The liquefied gas is stored on the tanker at a pressure of approximately 1 bar, whereas non-liquefied residual gases are returned to the platform or ship via a return line. The high-pressure line and the return line, which extend through the sea between the platform/ship and the LNG tanker, at both ends are taken up from the sea so that the end portions of the lines extend up from the water surface through free air and at their ends are connected to respective treatment units on the platform/ship and the LNG tanker, respectively.

With this transfer arrangement the high-pressure line and the return line will be subjected to external influences of different kinds under the different operational conditions which may occur-in practice. Difficult weather conditions with storms and high waves will place clear limitations on the system operation, as both security reasons and practical reasons will then render impossible disconnection of the lines from a LNG tanker having full loading tanks, and connection of the lines to another, empty LNG tanker. Under such weather conditions it will also present problems to keep the LNG tanker in position so that it does not turn or move and interferes with the lines. In addition, in arctic waters the lines may be subjected to collision with icebergs or ice floes floating on the water.

In offshore production of hydrocarbons (oil and gas) it is known to make use of production vessels which are based on the so-called STP technique (STP=Submerged Turret Production). In this technique there is used a submerged buoy of the type comprising a central bottom-anchored member communicating with the topical underground source through at least one flexible riser, and which is provided with a swivel unit for the transfer of fluid to a production installation on the vessel. On the central buoy member there is rotatably mounted an outer buoy member which is arranged for introduction and releasable securement in a submerged downwardly open receiving space at the bottom of the vessel, so that the vessel may turn about take anchored, central buoy member under the influence of wind, waves and water currents. For a further description of this technique reference may be made to e.g. international patent application WO 93/24731.

Further, in offshore loading and unloading of hydrocarbons it is known to use a so-called STL buoy (STL= Submerged Turret Loading) which is based on the same principle as the STP buoy, but which has a simpler swivel means; than the STP swivel which normally has several through-going passages or courses. For a further description of this buoy structure reference may e.g. be made to international patent application WO 93/11031.

By means of the STL/STP technique there is achieved that one can carry out offshore loading/unloading as well as offshore production of hydrocarbons in practically all kinds of weather, as both connection and disconnection between ship and buoy can be carried out in a simple and quick manner, also under very difficult weather conditions with high waves. Further, the buoy can remain connected to the vessel in all kinds of weather, a quick disconnection being able to be carried out if a weather limitation should be exceeded.

Because of the substantial practical advantages involved in the STL/STP technique, it would be desirable to be able to make use of this technique also in connection with offshore production of liquefied natural gas. One could then construct a field installation for the production of LNG on a production vessel or a production platform, and transfer the liquefied gas to a LNG tanker via a transfer line and a STP buoy, as the LNG tanker then would be built for connection/disconnection of such a buoy. However, this is not feasible is with the technique of today, since cryogenic transfer of LNG via a swivel, or also via conventional "loading arms", in practice is attended with hitherto unsolved problems in connection with freezing, clogging of passages etc. Such transfer is also attended with danger of unintentional spill of LNG on the sea, as this would be able to result in explosion-like evaporation ("rapid phase transition"), with a substantial destructive potential.

On this background it is an object of the invention to provide a method and a system for offshore production of LNG, wherein the above-mentioned weaknesses of the known system are avoided, and wherein one also avoids the mentioned problems attended with cryogenic medium transfer.

Another object of the invention is to provide a method and a system of the topical type which utilizes the STL/STP technique and the possibilities involved therein with respect to flexibility, safety and efficient utilization of the resources.

A further object of the invention is to provide a method and a system of the topical type which result in a relatively simple and cheap installation for conversion of natural gas to LNG.

For the achievement of the above-mentioned objects there is provided a method of the introductorily stated type which, according to the invention, is characterized in that the gas is supplied to the pipeline at a relatively high temperature, the pipeline being made heat transferring and having a sufficiently long length that the gas during the transfer through the pipeline is cooled to a desired low temperature near the sea water temperature during heat exchange with the surrounding sea water, and that the pipeline, when the storage tanks on the LNG tanker are filled up, is disconnected from the LNG tanker and connected to another, similar tanker, the pipeline in a manner known per se being permanently connected to a submerged buoy which is arranged for introduction and releasable securement in a submerged downwardly open receiving space in the tanker, and which is provided with a swivel unit for transfer of gas under a high pressure.

Further, there is provided a method of the introductorily stated type which, according to the invention, is characterized in that the gas is supplied to the pipeline at a temperature substantially below the sea water temperature, the low temperature of the gas being maintained during the transfer through the pipeline in that this is made heat insulating, and that the pipeline, when the storage tanks on the LNG tanker are filled up, is disconnected from the LNG tanker and connected to another, similar tanker, the pipeline in a manner known per se being permanently connected to a submerged buoy which is arranged for introduction and releasable securement in a submerged downwardly open receiving space in the tanker, and which is provided with a swivel unit for transfer of gas under a high pressure.

The above-mentioned objects are also achieved with a system of the introductorily stated type which, according to the invention, is characterized in that the pipeline at the end which is remote from the field installation, is permanently connected to at least one submerged buoy which, in a manner known per se, is arranged for introduction and releasable securement in a submerged downwardly open receiving space at the bottom of the LNG tanker, and which is provided with a swivel unit for transfer of gas under a high pressure.

By means of the method and the system according to the invention there is obtained a number of substantial structural and operational advantages. The utilization of the STL/STP concept entails that it is only necessary with minor hull modifications in order to construct the necessary receiving space for reception of the topical buoys. The hull of the LNG tanker can be designed in an optimal manner, so that vessels having a good seaworthiness can be obtained. The system will be far less subject to collisions and far less subject to external weather influences, as compared to the introductorily mentioned, known system. Further, one achieves the operational advantage that the LNG tanker can turn about the buoy under the influence of wind, waves and water currents. The pipeline which is connected to the buoy, can be connected and disconnected from the LNG tanker in a simple, quick and safe manner, also under very difficult weather conditions. The pipeline may be combined or integrated with a gas return line, and possibly also with a line for transfer of electrical power, in which case these lines then will be connected to special courses or transfer means in the buoy. This makes possible a simple transfer of return gas and/or possible electrical surplus power from the LNG tanker to the field installation.

In the method according to the invention there is first carried out a suitable pretreatment of the gas on the field installation, such as removal of condensate, dehydration of the gas and removal of $CO_2$, whereafter the gas is processed so as to be transferred through the pipeline to the LNG tanker in a condition which is optimized with a view to simplified and economic conversion of the gas to liquid form in the conversion plant on the LNG tanker. In this treatment the gas is compressed to a high pressure, preferably of at least 250 bars, whereby the gas is heated to a correspondingly high temperature, e.g. approximately 100° C. The gas thereafter is transferred through the pipeline in this form, and the pipeline then is made heat-transferring and has such a length that the gas temperature is lowered to the desired low level during the transfer.

However, it may also be advantageous to cool the compressed gas "maximally" at the field installation, i.e. to a temperature substantially below 0° C., and to transfer the gas in a compressed and cooled condition. In this case the low temperature will be maintained during the transfer through the pipeline, the pipeline then being made heat insulating.

Figure 2:
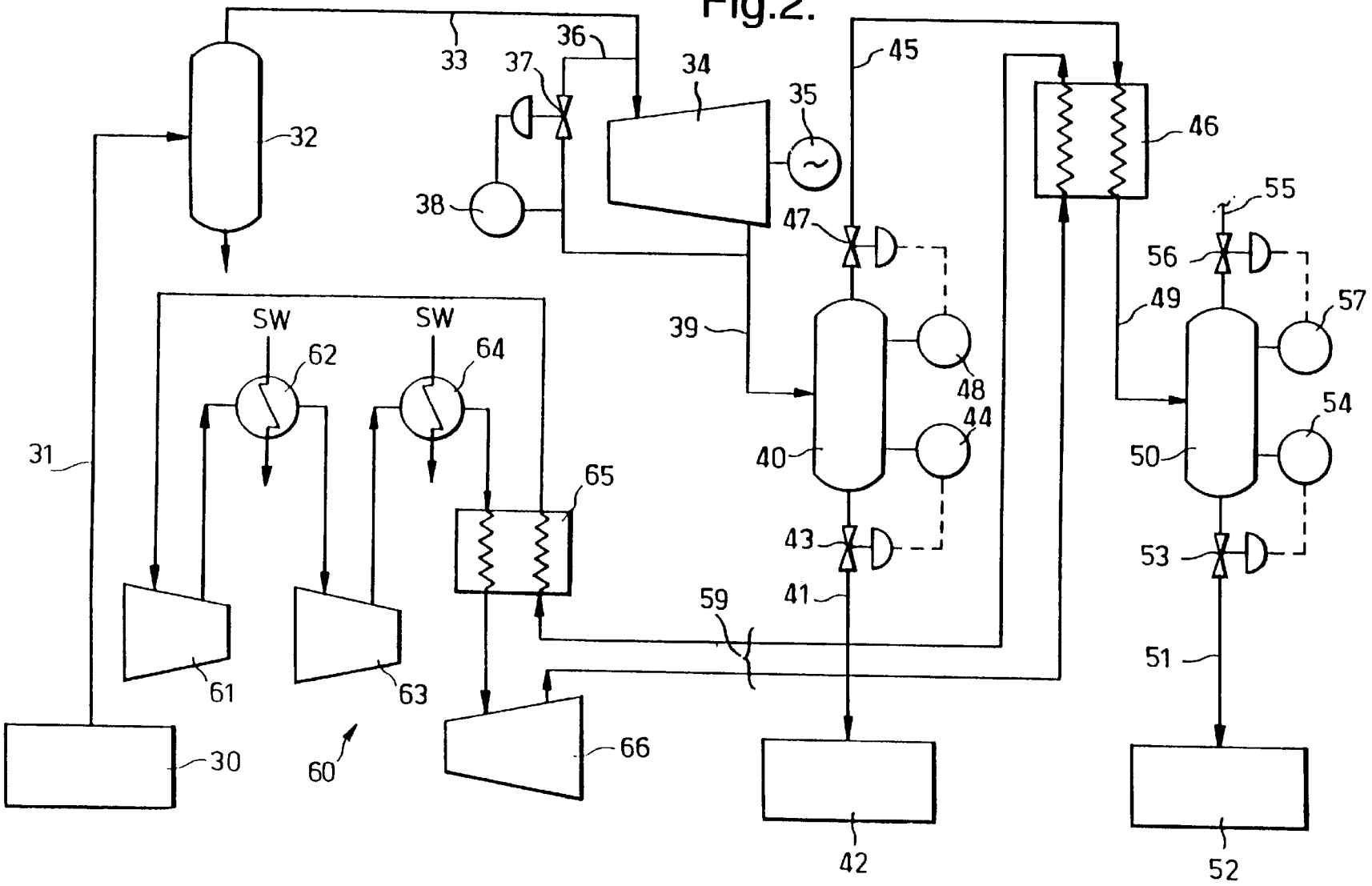
Figure 3:
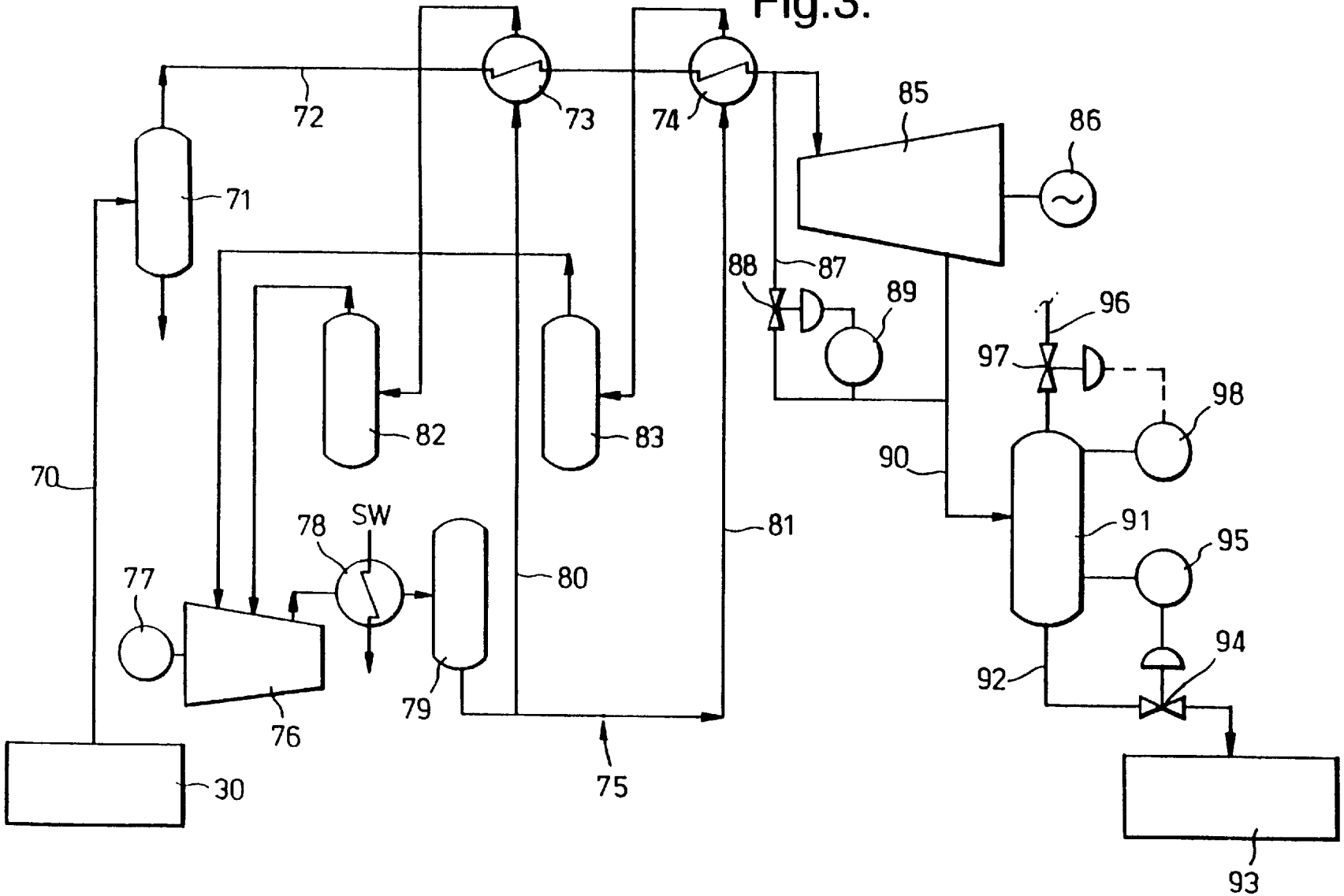

The invention will be further described below in connection with exemplary embodiments with reference to the drawings, wherein FIG. 1 is a schematic view showing the fundamental construction of the system according to the invention;

FIG. 2 shows a block diagram of a first embodiment of a plant for conversion of compressed natural gas on the transport vessel; and FIG. 3 shows a block diagram of a second embodiment of such a conversion plant.

In the embodiment shown in FIG. 1 the system comprises a floating production vessel (STP vessel) in the form of a barge 1 on which there is arranged a field installation 2 for treatment of gaseous fluid which, under a high pressure (e.g. approximately 200 bars), flows up from an underground source 3. The gaseous fluid is supplied through a wellhead 4 and a flexible riser 5 which extends through the body of water 6 and at its upper end is connected to a STP buoy 7 of the introductorily mentioned type. The buoy is introduced into and releasably secured in a submerged downwardly open receiving space 8 at the bottom of the barge 1. As mentioned above, the buoy comprises a swivel unit forming a flow connection between the riser 5 and a pipe system (not shown) arranged on the barge between the swivel and the field installation 2. The central member of the buoy is anchored to the sea bed 9 by means of a suitable anchoring system comprising a number of anchor lines 10 (only partly shown). For a further description of the buoy and swivel structure, reference is made to the aforementioned Norwegian laying-open print No. 176 129.

The field installation 2 consists of a number of processing units or modules 11 for suitable treatment of the supplied gas fluid, according to the composition of the well flow from the source 3 in the topical case. Generally, the gas consists of a number of components, such as condensate and $CO_2$, in addition to the natural gas proper. In the processing module the condensate (liquid fraction) is removed, the gas is dehydrated and $CO_2$ is removed. The separated condensate is stored on the barge, and is later transferred through a hose connection 12 to loading tanks on a conventional shuttle tanker 13 taking care of transport of the condensate to a land terminal.

After the gas has been processed as mentioned above, the dehydrated gas is compressed to a desired high pressure, preferably at least 300 bars, whereby also a heating of the gas to a relatively high temperature takes place. As mentioned above, the gas is now in a condition which is optimized with a view to conversion of the gas to liquid form in a conversion plant which is substantially cheaper to construct than conventional LNG plants. As mentioned above, it may, however, in some cases be advantageous also to cool the compressed gas "maximally" before the gas is supplied to the LNG plant.

A flexible pipeline 14 which is arranged for transfer of the compressed gas, extends through the body of water (the sea water) 6 between the barge 1 and a floating transport vessel in the form of a LNG tanker 15. One end of the pipeline at the barge 1 is permanently connected to the STP buoy 7 and is connected to the field installation 2 via the swivel unit of the buoy and said pipe system on the barge. The other end of the pipeline 14 is permanently connected to an additional STP buoy 16 which is introduced into and releasably secured in a submerged downwardly open receiving space 17 in the vessel 15. The buoy is provided with a swivel unit which may be of a similar design as that of the swivel unit in the buoy 7, and its central member is anchored to the sea bed 9 by means of an anchoring system comprising a number of anchor lines 18.

In addition to the buoy 16 (buoy I) there is also provided an additional submerged buoy 19 (buoy II) which is anchored to the sea bed by means of anchor lines 20. The pipeline 14 is also permanently connected to this buoy via a branch pipeline in the form of a flexible riser 14 which is connected to the pipeline 14 at a branch point 21. The purpose of the arrangement of two buoys will be further described later.

The pipeline 14 may extend over a substantial length in the sea, whereby a suitable distance between the barge 1 and the buoys I and II in practice may be 1–2 km. When compressed gas with a high temperature is to be transferred from the field installation 2 through the pipeline, this is made heat transferring, so that the gas temperature during the transfer is lowered to a desired low temperature close to the sea water temperature, e.g. 4–10° C. On the other hand, when compressed gas with a low temperature is to be transferred, the pipeline is made heat insulating, so that the gas temperature is maintained during the transfer.

An installation or plant 22 for conversion of compressed gas to liquid form is provided on the LNG tanker 15. The plant is supplied with compressed gas from the pipeline 14, the pipeline communicating with the plant via the buoy 16 and a pipe system (not shown) on the vessel. Liquefied natural gas which is produced in the plant, is stored in tanks 23 on board the vessel.

As mentioned, the natural gas is supplied in compressed and more or less cooled form to the conversion plant 22, and this plant therefore mainly is based on expansion of the gas to convert at least a part thereof to liquid form. In combination with at least one expansion step there is used one or more cooling steps which are located either before or after the expansion step or steps. The constructive design of the plant partly will be dependent on the nature of the topical gas, and partly on the results which are wanted to be achieved, i.a. with respect to efficiency, utilization of surplus energy, residual gas etc. which is produced during the process. In some cases it may be of interest to transfer residual gas, i.e. gas which is flashed off during the LNG process, back to the barge for recompression/cooling. In such cases the pipeline 14 may also comprise a return line for the transfer of such gas from the conversion plant back to the field installation. Further, in some cases it will be convenient to produce electrical energy as a by-product during the LNG process. In such cases the pipeline 14 may also comprise a power cable for the transfer of electric current from the LNG tanker 15 to the barge 1, as the swivel units of the STP buoys may be constructed for such transfer.

As shown in FIG. 1, the LNG tanker 15 is connected to the loading buoy 16 (buoy I), whereas the additional buoy 19 (buoy II) is submerged, in anticipation of connection to another LNG tanker. In practice it may be envisaged that the conversion plant 22 can produce approximately 8000 tons of LNG per day. With a vessel size of 80,000 tons, the vessel 15 will then be connected to the buoy I for ten days before its storage tanks 23 are full. When the tanks are full, the vessel leaves the buoy I, and the production continuous via the buoy II where another LNG tanker is then connected. The finished loaded vessel transports its load to a receiving terminal. Based on normal transport distances and said loading time, for example four LNG tankers may be connected to the shown arrangement of two buoys I and II, to thereby achieve operation with "direct shuttle loading" (DSL) without any interruption in the production.

Even if one can achieve direct shuttle loading with the shown arrangement, a continuous off-take of gas is not always an absolute presupposition, so that a LNG tanker does not have to be continuously connected to one of the loading buoys. Thus, the LNG tanker may leave the field/buoy for at least shorter periods (some days) without this having negative consequences.

Two embodiments of the conversion plant 22 on the vessel 15 will be described below with reference to FIGS. 2 and 3.

In the embodiment in FIG. 2 the gas arrives from the production vessel or barge 1 to the conversion plant 22 via the swivel unit of the STP buoy 16, which swivel unit here is designated 30. The gas arrives e.g. with a pressure of approximately 350 bars and a temperature of approximately 5° C. From the swivel 30 the gas is transferred via a pipeline 31 to a liquid separator 32 (a so-called knock-out drum) in which possible condensed liquid and solid particles are separated. From the liquid separator the gas is transferred via a pipeline 33 to an isentropic expansion turbine or turbo expander 34 wherein the gas is expanded from a high pressure to a low pressure and thereby is strongly cooled to a temperature of around −140° C. at which there is formed liquefied gas of a so-called heavy type. It may here be necessary to use several expansion steps, for example three turbines of 10 MW each.

An electrical generator 35 for the production of electrical power is connected to the expansion turbine 34. Further, the expansion turbine is bypassed by a bypass line 36 having a Joule-Thomson valve 37 which is influenced by a pressure-sensitive control means 38.

The expansion turbine is connected through a line 39 to a container or product collector 40 for heavy LNG. The pressure is here reduced to a low level, e.g. 3 bars. From the product container 40 a pipeline 41 leads to a tank 42 for cryogenic storage of the heavy LNG. In the pipeline 41 there is connected a level control valve 43 controlled by a level sensor 44.

An additional pipeline 45, which is connected to the top of the container 40, transports gas which has "flashed off" during the expansion process, to a low-pressure heat exchanger unit 46 for additional cooling of this gas. A pressure-controlled valve 47 which is controlled by a pressure control unit 48, is connected in the pipeline 45. The heat exchanger 46 may be a so-called plate-rib heat exchanger in which the utilized cooling medium may be nitrogen or a mixture of nitrogen and methane. In the heat exchanger most of the content of the gas of hydrocarbons and liquid is condensed.

The heat exchanger unit 46 is connected via a pipeline 49 to an additional product container 50 which, through a pipeline 51, is connected to a tank 52 for storage of the liquefied gas from the heat exchanger unit. The temperature at this point in the plant is lowered to a value of approximately −163° C., and the pressure may be close to 1 bar. In the pipeline 51 there is connected a level control valve 53 which is controlled by a level sensor 54.

At the top of the container 50 there is connected an additional pipeline 55 for discharge of residual gas from the container. This gas may, for example, be used as a fuel gas which may be utilized on board the vessel 15, e.g. for operation of the propulsion machinery thereof. Also in the line 55 there is connected a pressure-controlled valve 56 which is controlled by a pressure control unit 57.

As mentioned above, the utilized cooling medium in the heat exchanger unit 46 may be e.g. nitrogen. This cooling medium circulates in a cooling loop 59 forming part of a cryogenic cooling package 60 of a commercially available type, e.g. a unit of the type used in plants for the production of liquid oxygen. The cooling loop is shown to comprise a low-pressure compressor 61 which is connected to a condenser 62, and a subsequent high-pressure compressor 63 which is connected to a condenser 64, the condenser 64 being connected to a heat exchanger 65 for heat exchange of the cooling medium in the loop 59. Thus, the heat exchanger 65 contains a first branch leading from the condenser 64 to a cooling expander 66 the output of which is connected through the cooling loop 59 to the heat exchanger 46, and a second branch connecting the cooling loop 59 to the input of the low-pressure compressor 61. As a cooling medium in the condensers 62 and 64 for example sea water (SW) may be used.

Also in the embodiment shown in FIG. 3, the swivel unit of the STL buoy 16 is designated 30, and the gas is presupposed to arrive at the conversion plant 22 with a pressure of approximately 350 bars and a temperature of approximately 5° C. From the swivel unit the gas is transferred via a pipeline 70 to a liquid separator 71 for separation of possible condensed liquid and solid particles. In this embodiment of the conversion plant, the gas goes through a precooling before it is subjected to pressure lowering and cooling by means of expansion. The gas from the liquid separator 71 thus is transported through a pipeline 72 to a pair of serially connected condensers 73 and 74 in which the temperature of the gas is lowered to approximately −35° C.

The condensers 73 and 74 are cooled by means of a cooling medium circulating in a two-step cooling loop 75 using propane as a cooling medium. As shown, the cooling loop comprises a compressor 76 which is driven by a generator 77 and is coupled via a condenser 78 to a liquid separator 79. The condenser is cooled by means of sea water (SW).

To the output of the liquid separator 79 there is connected a pair of pipelines 80 and 81 which are connected to a respective one of the two condensers 73 and 74, and these pipelines 80, 81 are connected via the condensers to a respective one of a pair of additional liquid separators 82, 83 the outputs of which are connected to respective inputs of the compressor 76.

The cooled gas is supplied to an isentropic expansion turbine 85 in which the gas is expanded from a high pressure to a low pressure and thereby is cooled additionally to such a low temperature that most of the gas is converted to liquid form. The temperature here may be approximately −164° C.

Also here an electrical generator 86 for the production of electrical power is associated with the expansion turbine 85. Further, the expansion turbine is bypassed by a bypass line 87 having a Joule-Thomson valve 88 which is influenced by a pressure-sensitive control means 89.

The expansion turbine 85 is connected via a line 90 to a product container 91 for the liquefied gas from the expansion turbine 85. From the container 91 a pipeline 92 leads to a tank 93 for storage of the produced LNG. The pressure here may be approximately 1,1 atmospheres, and the temperature may be approximately −163° C. In the pipeline 92 there is connected a level control valve 94 which is controlled by a level sensor 95.

To the top of the container 91 there is connected an additional pipeline 96 for discharge of residual gas from the container. This gas may be utilized in a similar manner as stated in connection with the embodiment according to FIG. 2. Also in the line 96 there is connected a pressure-controlled valve 97 which is controlled by a pressure-control unit 98.

In the embodiments according to FIGS. 2 and 3 there is stated that the pressure in said expansion steps is reduced to a level close to 1 bar. However, it may be Convenient to convert the gas to liquid form at a higher pressure, e.g. in the range 10–50 bars, as the temperature then does not need to be reduced to such a low level as stated above, viz. around −163° C. This may be economically advantageous, since an additional temperature lowering in the range down towards said temperature is relatively expensive. With such a conversion under a high pressure, the liquefied gas will also be stored under the topical higher pressure.

We claim:

1. A method for offshore production of liquefied natural gas comprising the steps of:

A) supplying natural gas from an underground source to a field installation for gas treatment;

B) transferring the gas in a compressed form from the field installation to a first LNG tanker through a pipeline surrounded by sea water, said pipeline being capable of heat transfer and having a length that allows the gas to be cooled, said transferring step including supplying the gas to said pipeline at a high temperature relative to the temperature of the sea water;

C) cooling the gas within the pipeline to a temperature near the temperature of the sea water;

D) feeding the compressed gas to a conversion plant provided on the LNG tanker;

E) converting at least a part of the fed compressed gas to liquefied form by expansion of the gas;

F) transferring the liquefied gas to storage tanks on board the LNG tanker;

G) disconnecting the pipeline when the storage tanks on the LNG tanker are filled; and H) connecting the disconnected LNG pipeline to another tanker, wherein the pipeline is permanently connected to a submerged buoy provided with a swivel unit for transferring gas under a high pressure, and said connecting step includes introducing and releasably securing said submerged buoy in a submerged downwardly open receiving space in the another tanker.

2. The method according to claim 1, wherein said transferring step includes transferring said gas at a pressure of at least 250 bars.

3. The method according to claim 1 wherein said gas from said field installation is purified before being transferred from said field installation.

4. A method for offshore production of liquefied natural gas comprising the steps of:

A) supplying natural gas from an underground source to a field installation for gas treatment;

B) transferring the gas in a compressed form from the field installation to a first LNG tanker through a pipeline surrounded by sea water, said pipeline being insulated so as to prevent heat transfer between the gas and the sea water, said transferring step including supplying the gas to said pipeline at a temperature substantially below the temperature of the sea water;

C) maintaining the gas within the pipeline at a temperature substantially below the temperature of the sea water;

D) feeding the compressed gas to a conversion plant provided on the LNG tanker;

E) converting at least a part of the fed compressed gas to liquefied form by expansion of the gas;

F) transferring the liquefied gas to storage tanks on board the LNG tanker;

G) disconnecting the pipeline when the storage tanks on the LNG tanker are filled up; and H) connecting the disconnected pipeline to another LNG tanker, wherein the pipeline is permanently connected to a submerged buoy provided with a swivel unit for transferring gas under a high pressure, and said connecting step includes introducing and releasably securing said submerged buoy in a submerged downwardly open receiving space in the another tanker.

5. The method according to claim 4, wherein said transferring step includes transferring said gas at a pressure of at least 250 bars.

6. The method according to claim 4 wherein said gas is purified before being transferred from said field installation.

7. A system for offshore production of liquefied natural gas, comprising a field installation for processing of natural gas supplied to the installation from an underground source, equipment arranged on the field installation for gas purification and for compression of the natural gas to a high pressure, and a pipeline to be surrounded by sea water for the transfer of the compressed gas to a LNG tanker, the LNG tanker comprising a plant for conversion of at least a part of the gas to a liquefied form by expansion of the gas, and storage tanks for storage of the liquefied gas on the tanker, and wherein an end of the pipeline which is remote from the field installation is permanently connected to at least one submerged buoy arranged for introduction and releasable securement in a submerged downwardly open receiving space at the bottom of the LNG tanker, said at least one submerged buoy includes a swivel unit for transferring gas under a high pressure.

8. The system according to claim 7 wherein said at least one submerged buoy includes a pair of submerged buoys, and the pipeline is connected to said pair of submerged buoys by respective flexible risers.

9. A system according to claim 7 or 8, wherein the field installation is arranged on a production vessel or a barge; and said pipeline includes an end for connecting to the field installation and permanently connected to a submerged field installation buoy, said submerged field installation buoy is arranged for introduction and releasable securement in a submerged downwardly open receiving space at the bottom of the barge or production vessel, and includes a swivel unit for transferring gas under a high pressure, said submerged field installation buoy swivel unit is connected to a transfer line communicating with the underground source.

10. A system according to any of the claims 7 or 8, wherein the gas is transferred through the pipeline at a relatively high temperature, and wherein the pipeline is capable of heat transfer and has a sufficiently long length that the gas within the pipeline is cooled to a desired low temperature close to the sea water temperature when the pipeline is surrounded by sea water.

11. A system according to any of the claims 7 or 8, wherein the gas is transferred to the pipeline at a temperature substantially below the temperature of the sea water, and wherein the pipeline is capable of insulating against heat transfer so that the low temperature of the gas within the pipeline is substantially maintained.

* * * * *